US007240532B2

(12) United States Patent
Zhang et al.

(10) Patent No.: US 7,240,532 B2
(45) Date of Patent: Jul. 10, 2007

(54) HYBRID METAL FORMING SYSTEM

(75) Inventors: Wenwu Zhang, Schenectady, NY (US); David Peter Mika, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 11/633,206

(22) Filed: Dec. 4, 2006

(65) Prior Publication Data

US 2007/0089476 A1 Apr. 26, 2007

Related U.S. Application Data

(62) Division of application No. 10/878,590, filed on Jun. 28, 2004, now Pat. No. 7,162,910.

(51) Int. Cl.
*B21D 1/06* (2006.01)
*B21D 26/14* (2006.01)

(52) U.S. Cl. ..... 72/430; 72/56; 72/706; 72/710; 29/421.1

(58) Field of Classification Search ..... 72/54, 72/56, 57, 60, 430, 706, 710; 29/421.1
See application file for complete search history.

(56) References Cited

U.S. PATENT DOCUMENTS

| | | | | |
|---|---|---|---|---|
| 3,347,074 | A | 10/1967 | Eilers et al. | |
| 3,541,823 | A | 11/1970 | Weadock | |
| 3,654,787 | A | 4/1972 | Brower | |
| 4,531,393 | A | 7/1985 | Weir | |
| 4,559,807 | A * | 12/1985 | Ganago et al. | 72/454 |
| 4,658,629 | A * | 4/1987 | Milisavljevic | 72/706 |
| 5,728,309 | A | 3/1998 | Matsen et al. | |
| 5,826,320 | A | 10/1998 | Rathke et al. | |
| 6,050,120 | A | 4/2000 | Daehn et al. | |
| 6,050,121 | A | 4/2000 | Daehn et al. | |
| 6,199,271 | B1 | 3/2001 | Hahn et al. | |
| 6,862,913 | B2 | 3/2005 | Lempenauer et al. | |
| 7,162,910 | B2 * | 1/2007 | Zhang et al. | 72/430 |

* cited by examiner

*Primary Examiner*—David Jones
(74) *Attorney, Agent, or Firm*—Fletcher Yoder

(57) ABSTRACT

A hybrid metal forming system includes a die cavity defined by a first die and a second die and a press adapted to apply a static pressure over the first die to deform a workpiece against the second die. The hybrid forming system also includes a dynamic loading system coupled to and positioned between, the press and the die cavity.

28 Claims, 9 Drawing Sheets

HYBRID METAL FORMING SYSTEM

CROSS-REFERENCE TO RELATED APPLICATIONS

This application is a divisional of U.S. application Ser. No. 10/878,590, now U.S. Pat. No. 7,162,910, entitled HYBRID METAL FORMING SYSTEM AND METHOD, filed Jun. 28, 2004, which is herein incorporated by reference.

BACKGROUND

The invention relates generally to forming and repair of workpieces in a manufacturing environment and, more specifically, to forming and repair of high precision metal parts.

Various types of metal structures, used in a range of commercial, industrial and consumer applications are made by deformation under an applied load. Certain such structures may be repaired in similar remanufacturing operations. For example, engine blades in aircraft engines are manufactured to high and stringent tolerances to ensure high quality performance of the engine. Engine blades may be deformed as a result of loading such as, thermal stress, external collision and so forth. Such deformation in the blades may include for example, bending and twisting in operations similar to forging or other plastic deformation processes.

As a result, various types of precision forming and repair techniques have been developed to make and repair these workpieces with a high level of accuracy. In some conventional practices, a workpiece blank is formed, and the blank is manually or semiautomatically bent or twisted. Such operations may be repeated both for original manufacture and to repair the workpiece. Such techniques are time consuming and require highly skilled workers to achieve the desired level of accuracy. Certain other methods employ pressing the workpiece in a warm die and holding it for a sufficiently long time to achieve the desired shape. Such techniques may result in having a spring back effect in the workpiece that limits the accuracy of the repair of the workpiece.

In certain other conventional repair and forming techniques, for example in sheet metal forming, electromagnetic pressure forming has been employed for repairing and forming a workpiece. Such processes generally rapidly accelerate a workpiece blank under the influence of a strong electromagnetic field. The utility of electromagnetic pressure forming for workpiece manufacture and repair is typically limited to high conductivity materials because the forming efficiency for the low conductivity metals is very low owing to the inability to accelerate such materials via the field. Certain other techniques use integration of low rate and high rate forming methods but such techniques require manufacturing of dies for each production cycle, as the dies must necessarily conform to the shape of the workpiece and therefore the same die cannot be used for different workpieces.

Therefore, it would be desirable to develop a technique that enables a workpiece to be formed and repaired in a more efficient manner. More specifically, it would be desirable to have an efficient forming and repair technique that permit precision workpiece forming and repair while having adaptability for a wider range of workpieces.

BRIEF DESCRIPTION

Briefly, in accordance with one aspect of the present invention a hybrid metal forming system includes a die cavity defined by a first die and a second die and a press adapted to apply a static pressure over the first die to deform a workpiece against the second die. The hybrid forming system also includes a dynamic loading system coupled to and positioned between, the press and the die cavity.

In accordance with another aspect of the present invention a method of forming a workpiece comprises moving a die to deform a workpiece under a static load and indirectly dynamically loading the die against the workpiece while maintaining the static load.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

As discussed in detail below, the embodiments of the present technique employ an integration of a static load and a dynamic load for precision forming and repair of a workpiece in a manufacturing environment. It should be noted here that the static load may include a slow time varying load as compared to the dynamic load. The integration of the static load and the dynamic load includes loading a material of the workpiece in a combined environment of elastic-plastic and hyperplastic regimes that will be discussed in detail hereinafter. In particular, the slow time varying load may serve effectively as a static load based upon the strain rate or deformation regime implied by the rate of change of the loading.

Figure 1:
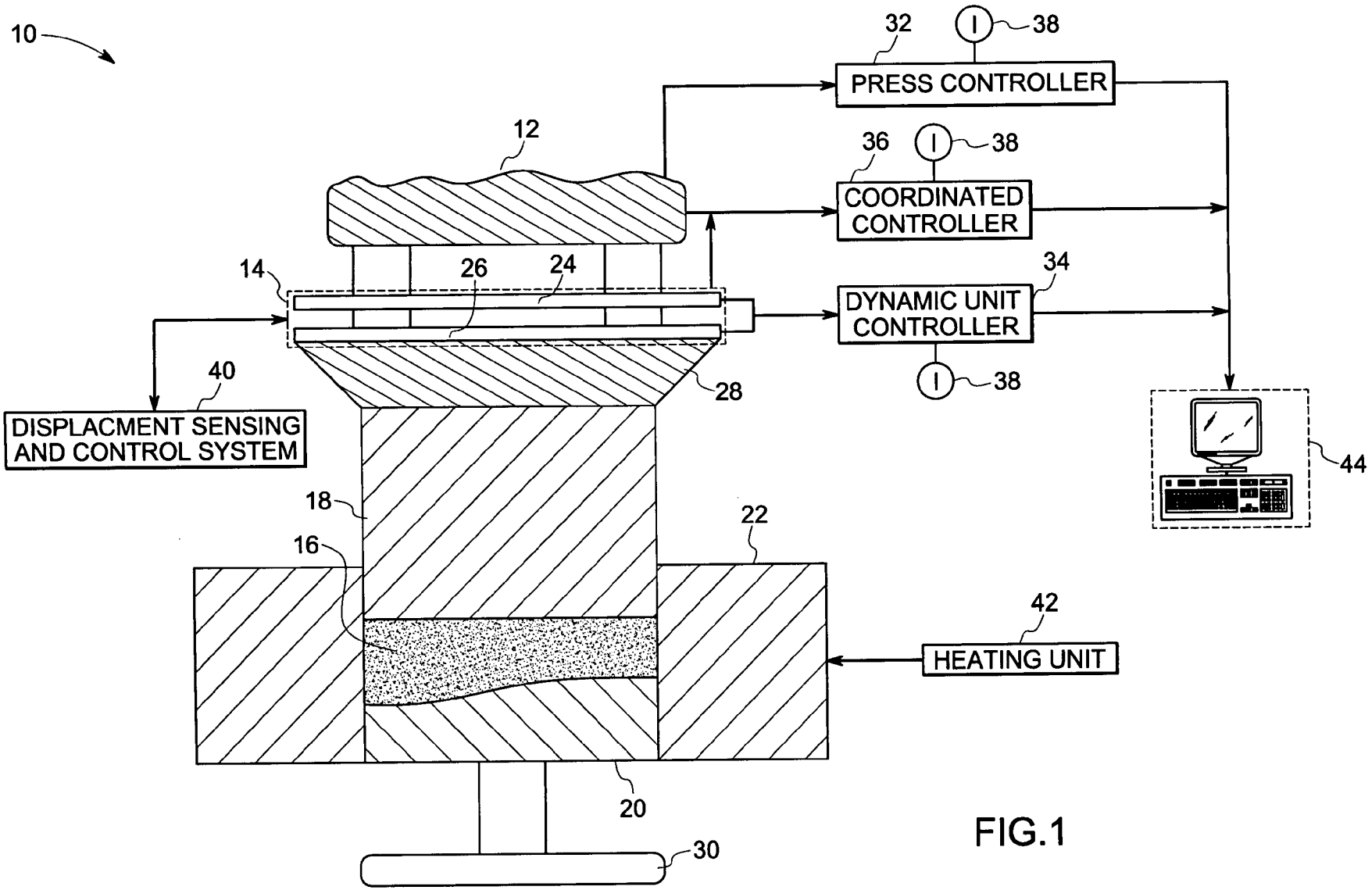
FIG. 1 is a diagrammatical representation of an exemplary hybrid metal forming system.

Referring now to FIG. 1, an exemplary hybrid forming system 10 is illustrated. The illustrated system 10 comprises a press 12 and a dynamic loading system 14 for forming or repairing a workpiece 16. In this embodiment, the workpiece 16 comprises a metal part although the technique may be applied to other deformable parts. In the illustrated embodiment, the workpiece 16 is disposed between a first die 18 and a second die 20 within a die cavity 22. The dynamic loading system 14 is coupled to and positioned between the press 12 and the die cavity 22. In this embodiment, the dynamic loading system 14 comprises an electromagnetic pressure unit. Further, the dynamic loading system 14 comprises a forming coil 24 and a driver plate 26 for applying a dynamic pressure to the workpiece 16. In the illustrated embodiment, the driver plate 26 comprises a conductive metal, such as, but not limited to, copper, beryllium copper and aluminum alloy. In a presently contemplated configuration, a stress enhancer unit 28 is disposed adjacent to the dynamic loading system 14 to enhance a stress wave effect. Also, illustrated in the FIG. 1 is a removing unit or ejector 30, where appropriate, to assist in a removal of the workpiece 16 after the workpiece 16 is formed or repaired.

In addition, a press controller 32 is coupled to the press 12 and a dynamic unit controller 34 is coupled to the dynamic loading system 14 for controlling the operation of the press 12 and the dynamic loading system 14, respectively. Further, a power source 38 is provided for operation of each of the controllers as listed above. In practice, the different loading systems may employ different power supplies based upon the needs of the loading systems. In the illustrated embodiment, the power supply 38 for the dynamic loading system 34 comprises a high voltage capacitor bank. A displacement sensing and control system 40 is coupled to the forming coil 24 and the driver plate 26 to maintain a desired spacing between the first die 18 and the second die 20. Moreover, a heating unit 42 may be coupled to the die cavity 22 for heating at least one of the first die 18 and the second die 20. Alternatively, the heating unit 42 may be employed for heating the workpiece 16 to enhance a formability of the workpiece 16. Further, an operator workstation 44 may be coupled to the press controller 32, the dynamic unit controller 34 and the coordinated controller 36 to facilitate controlling the operation of the press controller 32, the dynamic unit controller 34 and the coordinated controller 36 respectively.

In operation, the workpiece 16 is placed in the die cavity 22 and a static pressure is applied to the first die 18 via the press 12 to deform the workpiece 16 against the second die 20. In one embodiment, the press 12 comprises a mechanical press. In another embodiment, the press 12 comprises a hydraulic press. Next, a dynamic load is applied to the die cavity 22 via the dynamic loading system 14. In this embodiment, the dynamic loading system 14 comprises an electromagnetic pressure unit, though various other systems to perform a similar function may be used. Examples of such systems include an air driven impact pressing system, an impact pressing system driven by a spring, a hydraulic impact pressing system, an explosive charge driven system, and so forth.

In general, the forming coil 24 is coupled to the first die 18 to facilitate an indirect loading of the workpiece 16 via the dynamic loading system 14. Typically, the forming coil 24 and the driver plate 26 are positioned to maintain an initial spacing between the forming coil 24 and the driver plate 26. The spacing between the forming coil 24 and the driver plate 26 may change after the dynamic load is applied to the die cavity 22 via the dynamic loading system 14. The spacing between the forming coil 24 and the driver plate 26 may be adjusted via the displacement sensing and control system 40 by sensing a position of the driver plate 26 and the forming coil 24 as will be described in detail below.

In the illustrated embodiment, the dynamic loading system 14 indirectly applies a dynamic load to the die cavity 22 against the workpiece 16 through the forming coil 24 and the driver plate 26. In this embodiment, the dynamic load is an electromagnetic pressure applied via the dynamic loading system 14. The dynamic loading system 14 discharges energy to generate a discharging current in the forming coil 24 and an induced current in the driver plate 26. The discharging current in the forming coil 24 and the induced current in the driver plate 26 repel each other. As a result, the driver plate 26, stress enhancer unit 28 and the first die 18 are accelerated towards the workpiece 16 to load the workpiece 16 dynamically. As will be appreciated by those skilled in the art a plurality of electromagnetic pulses may be applied to the die in a similar manner as described above to achieve a desired size and shape of the workpiece.

Further, on completion of a cycle of the repair or forming process as described above, variations in dimensions of the formed/repaired workpiece 16 are measured and these variations in dimensions are verified with respect to desired tolerances for the dimensions. If the variations in dimensions of the formed/repaired workpiece 16 are within the desired tolerances, the workpiece 16 may be removed from the removing unit 30. Alternatively, if the measured variations in dimensions are outside range of the desired tolerances, then the dynamic load may be reapplied to the workpiece 16 to achieve the desired dimensions of the workpiece 16.

The technique illustrated and described above employs an integration of the static load and the dynamic load for the workpiece forming and repair process. As can be seen above, the application of the dynamic load to the workpiece 16 is performed in an indirect manner via application of the dynamic load to the first die 18 and the second die 20 and subsequently transfer of this dynamic load to the workpiece 16. The indirect application of the dynamic load enables the first die 18 and the second die 20 to be used for forming and repair of workpieces 16 of different size and shapes without replacing the first die 18 and the second die 20 for each cycle. Further, because the dynamic loading unit 14 is isolated from the die cavity 22, the same dynamic loading unit 14 with the forming coil 24 and the driver plate 26 may be used for application of dynamic load to different parts by means of different dies.

Moreover, the heating unit 42 may be employed to heat the first die 18, the second die 20 and/or the workpiece 16 that enhances the formability of the workpiece 16. The heating unit 42 may be operable to apply a thermal environment to the first die 18, the second die, 20 and the workpiece 16 independently in isolation with the dynamic loading system 14. As a result, the dynamic loading system 14 may be operated at a room temperature and the first die 18, the second die 20 and the workpiece 16 may be operated in an elevated temperature environment. The heating of the first die 18, the second die 20 and the workpiece 16 may be done by placing the workpiece 16 and the first and second dies 18 and 20 in a heated furnace. Alternatively, an electrical heating unit may be coupled to the die cavity 22 that may be employed for heating the first and second dies 18 and 20.

In the illustrated embodiment, the operation of the press 12 is controlled via the press controller 32 that may control the operational parameters of the press 12, such as, the static load, time for loading the workpiece 16 via the press 12 and so forth. Further, the dynamic load unit 14 is coupled to the dynamic unit controller 34 to control the operation of the dynamic load unit 14. Such control may include controlling the spacing between the forming coil 24 and the driver plate 26, controlling the dynamic load applied via the dynamic load unit 14 and so forth. In addition, the coordination of operation of the press 12 and the dynamic load unit 14 may be controlled via the coordinated controller 36. For example, the coordinate controller 36 may control the cycle time of operation of the press 12 and the dynamic load unit 14 for the forming and repair process.

Figure 2:
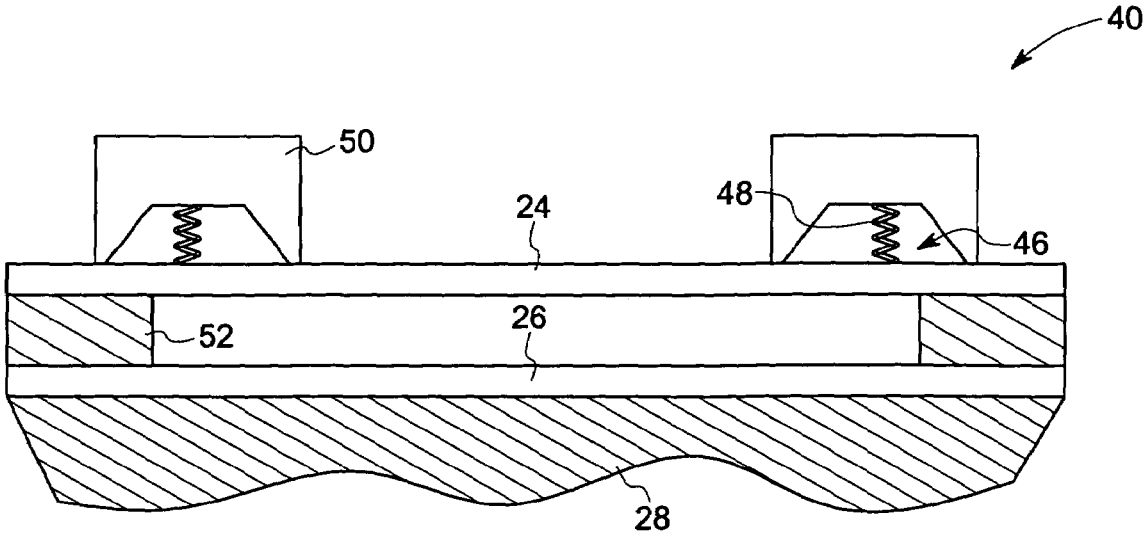
FIG. 2 is a diagrammatical representation of an exemplary displacement control system for a dynamic unit of the hybrid metal forming system of FIG. 1.

FIG. 2 illustrates the exemplary displacement sensing and control system 40 for controlling the spacing between the forming coil 24 and the driver plate 26 of the dynamic load unit 14 of FIG. 1. In this embodiment, the displacement sensing and control system 40 comprises a load application structure 46 that may have a spring assembly 48 to apply a load for controlling the spacing between the forming coil 24 and the driver plate 26. In addition, the displacement sensing and control system 40 also comprises a stopper 50 and a spacer 52. In operation, before application of the dynamic load the stopper 50 is disposed over the forming coil 24 that is placed at an optimum distance from the driver plate 50. The stopper 50 is adapted to constrain an upward movement of the forming coil 24 while the dynamic load is applied via the forming coil 24 and the driver plate 26.

It should be noted that after completion of a cycle of application of the dynamic load, the driver plate 26 and the spacer 52 move in a downward direction that changes the spacing between the forming coil 24 and the driver plate 26. Subsequently, the load application structure 46 with the spring assembly 48 applies a load to the forming coil 24 towards the spacer 52 to adjust the spacing to the optimum distance before the application of next cycle of the dynamic load. In practice, the gap may be effectively regulated by means of the spacer 52, or a series of such spacers. Thus, the technique illustrated above may be employed to maintain the optimum distance between the forming coil 24 and the driver plate 26 for each cycle of dynamic load operation in the forming and repair process of the workpiece 16. It should be noted that guides (not shown) may be used to constrain movement of the driver plate and movable die in an axial direction. Moreover, where the spacer or spacers effectively control the gap between the dies, a displacement control system may not be required in the system.

Figure 3:
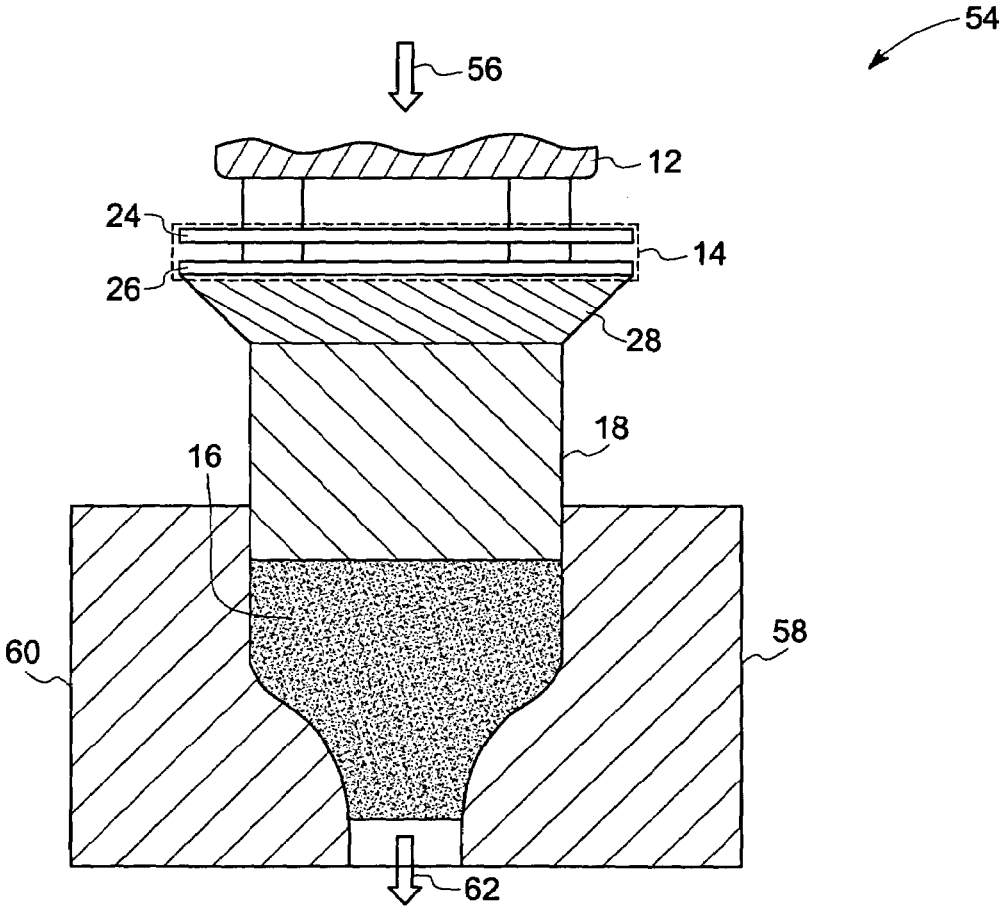
FIG. 3 is a diagrammatical representation of an exemplary hybrid metal forming system employed for extrusion of a metal according to one aspect of the invention.

The method described herein above may be employed for variety of operations in a manufacturing environment. For example, the technique may be used for an extrusion of a workpiece 16 as illustrated in FIG. 3. FIG. 3 illustrates an exemplary hybrid metal forming system 54 employed for extrusion of a workpiece 16 in accordance with aspects of the present invention. In a presently contemplated configuration, the hybrid metal forming system 54 employs an integration of static load that is applied in a direction 56 via a press 12 and dynamic load applied via the dynamic load unit 14. In a present configuration, the workpiece 16 may be placed between the first die 18 and first and second lower dies 58 and 60. The first lower 58 and the second lower die 60 are placed adjacent each other and the workpiece 16 is disposed between the first and second lower dies 58 and 60 to facilitate the extrusion of the workpiece 16. The first die 18 is loaded by the press 12 in the direction 56 to deform the workpiece 16. Subsequently, the first die 18 is loaded indirectly against the workpiece 16 for the extrusion of the workpiece 16 in a direction 62. After the extrusion of the workpiece 16 is achieved, the workpiece 16 is removed from the hybrid metal forming system 54.

Figure 4:
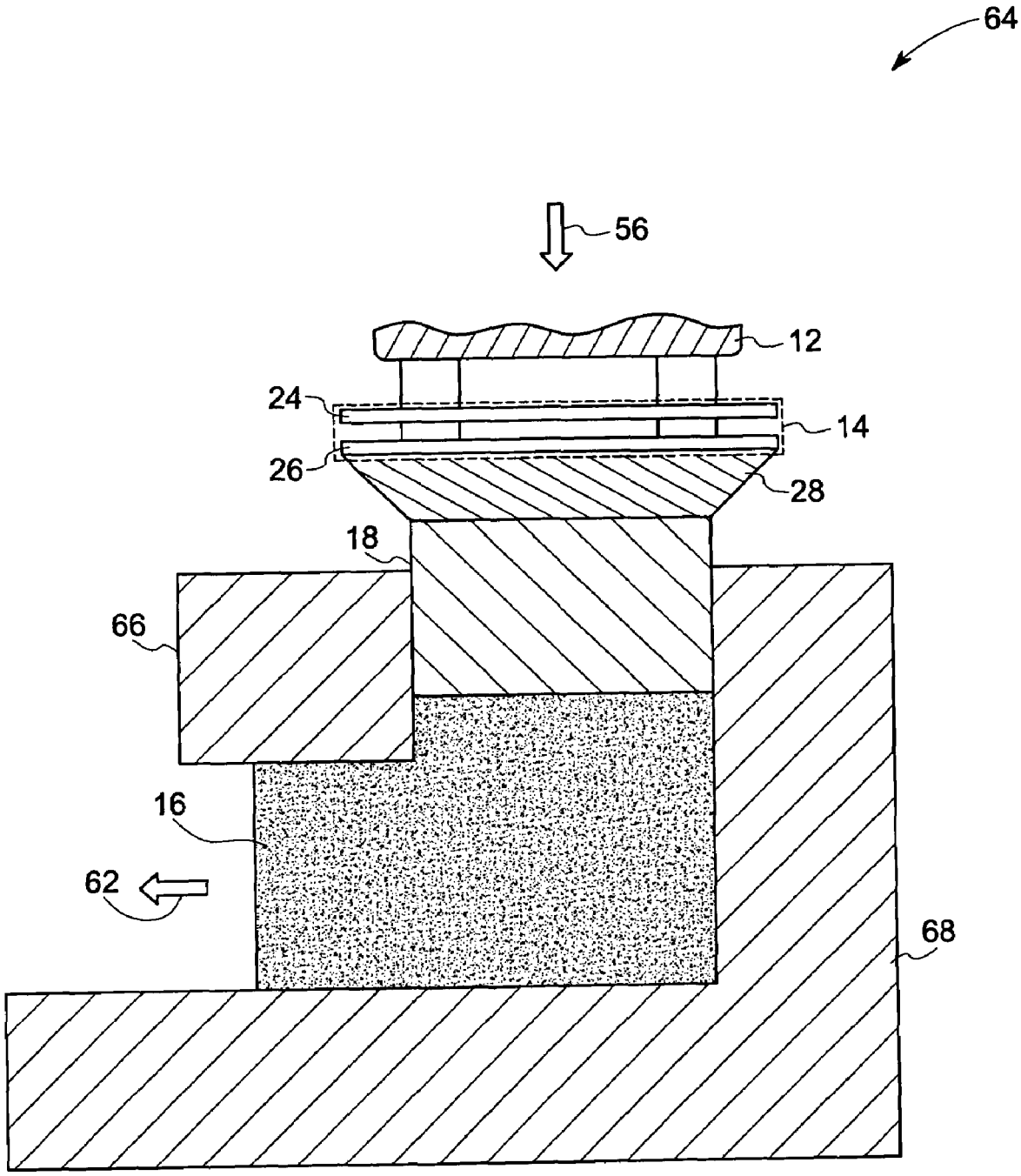
FIG. 4 is a diagrammatical representation of an exemplary hybrid metal forming system employed for equal channel angular extrusion of a metal part according to one aspect of the invention.

The extrusion technique as illustrated above may be employed for an equal channel angular extrusion of the workpiece 16 as illustrated in FIG. 4. In this embodiment, an equal channel angular extrusion set up 64 with a first lower die 66 and a second lower die 68 is illustrated. The first and second lower dies 66 and 68 are positioned in a channel set up to facilitate the extrusion of the workpiece 16 in a desired shape. As can be seen, the static load is applied in a direction 56 to deform the workpiece 16. Subsequently, the dynamic load is applied indirectly via the dynamic load unit 14. Further, this load is concentrated via the stress enhancer unit 28 to facilitate the extrusion of the workpiece 16 in a desired shape. Subsequently, the formed workpiece 16 may be removed in the direction 62.

Figure 5:
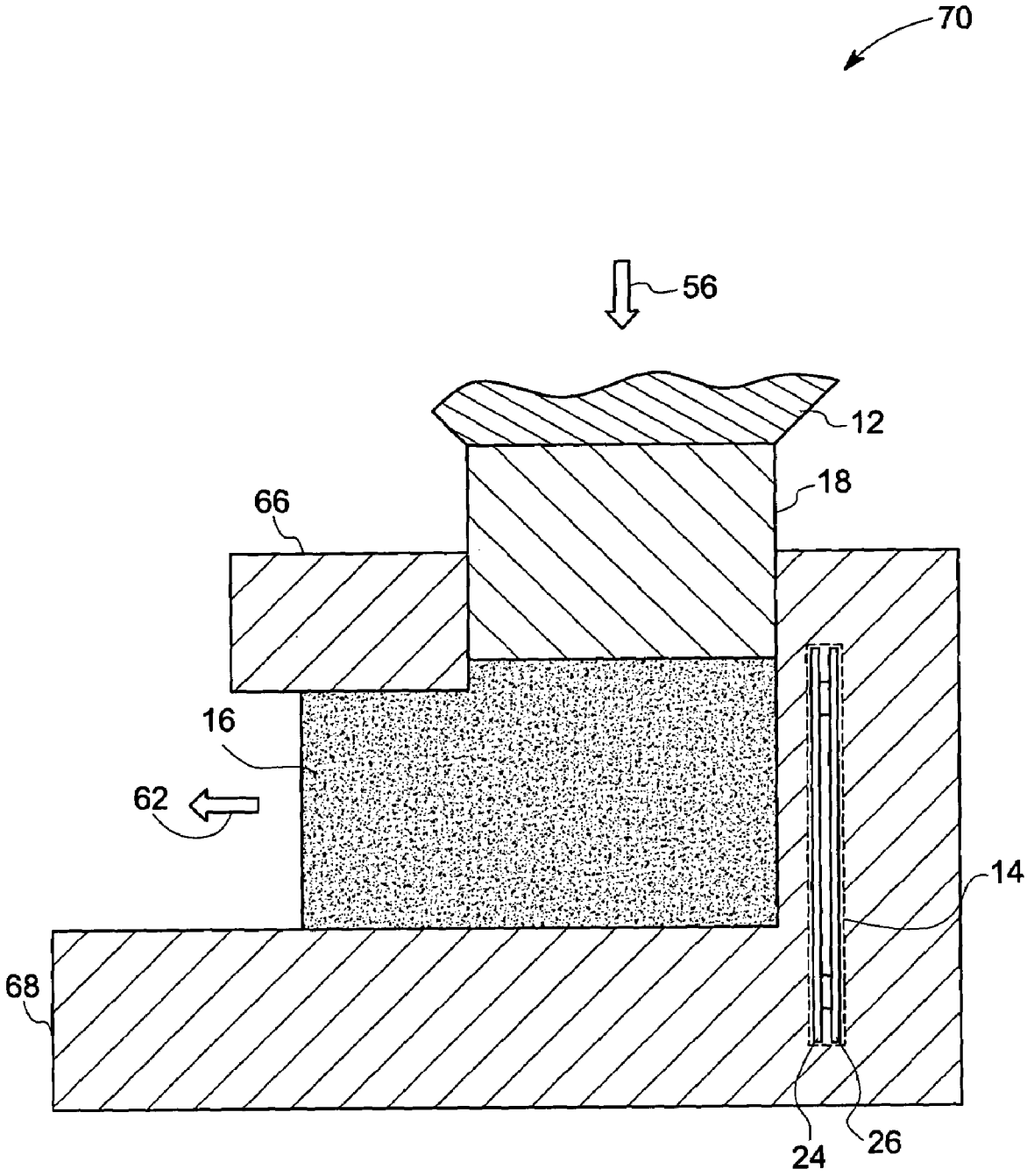
FIG. 5 is a diagrammatical representation of an exemplary hybrid metal forming system employed for equal channel angular extrusion of a metal part according to another aspect of the invention.

FIG. 5 illustrates an exemplary equal channel angular extrusion set up 70. In this embodiment, the dynamic unit 14 may be positioned vertically such that the direction of application of the dynamic load via the dynamic load unit 14 may be at right angles to the direction of application 56 of the static load. This arrangement employs application of static load in the direction 56 to the workpiece 16 to deform initially. Subsequently, the die and workpiece 16 may be loaded dynamically via the dynamic load unit 14 in the direction 62 to facilitate the extrusion in the direction 62.

Figure 6:
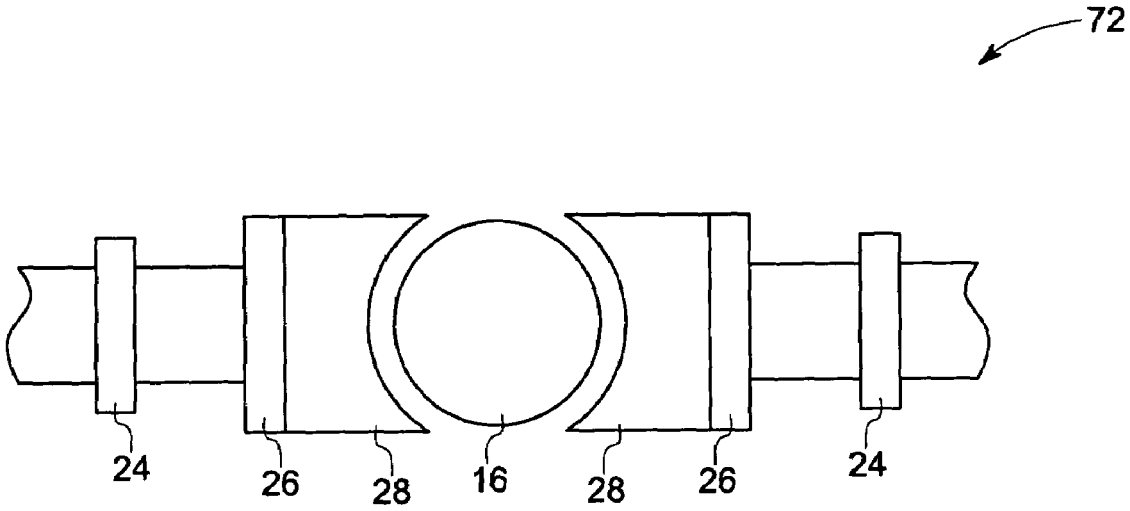
FIG. 6 is a diagrammatical representation of an exemplary hybrid metal forming system employed for axisymmetric applications according to one aspect of the invention.

As noted above, the present technique allows for integration of static and dynamic load for forming and repair of workpieces 16 in a manufacturing environment. FIG. 6 illustrates the application of the hybrid forming technique for an axisymmteric application. In a presently contemplated configuration, the hybrid forming system 72 for axisymmetric applications the workpiece 16 is disposed between with the forming coil 24, the driver plate 26 and the stress enhancer unit 28 on either sides of the workpiece 16. As will be appreciated by those skilled in the art, a large number of variations may be devised for the hybrid forming system 72 employing multiple number of forming coil 24 and driver plate 26 to perform a variety of axisymmetric tasks. Of course, even in axisymmetric applications, where such redundant coils are not required, a single coil may be employed.

Figure 7:
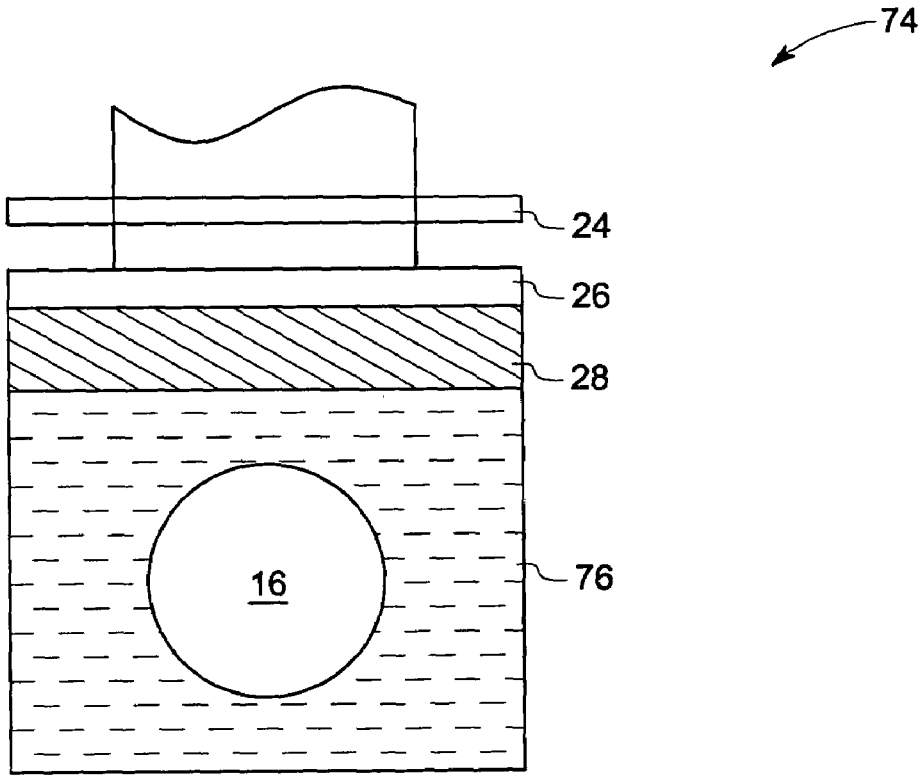
FIG. 7 is a diagrammatical representation of an exemplary hybrid metal forming system with fluid media according to one aspect of the invention.

By way of example, FIG. 7 illustrates a hybrid forming system 74 with a fluid medium. In this embodiment, the workpiece 16 may be placed inside a fluid medium 76. The forming coil 24, the driver plate 26 and the stress enhancer unit 28 may be coupled to the fluid medium 76. In this embodiment, a fluid pressure of the fluid media 76 may be used as a conformal pressure for loading the workpiece 16 for the forming process. The hybrid forming systems described in detail above can be operated in various ways, such as the exemplary processes described in detail below with reference to FIGS. 8–10.

Figure 8:
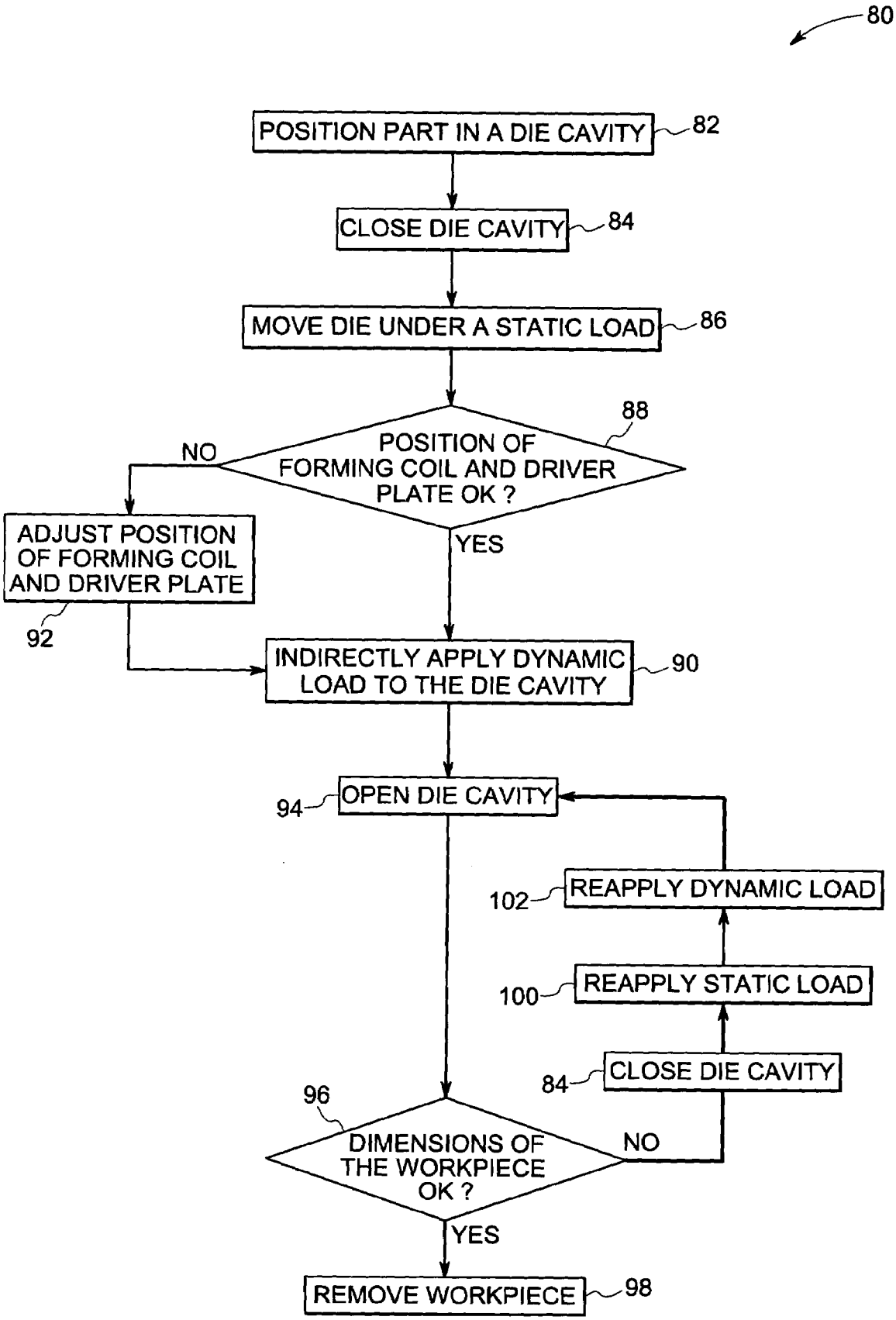
FIG. 8 is a flow chart illustrating a method of forming a part using the hybrid metal forming system of FIG. 1 according to one aspect of the invention.
Figure 9:
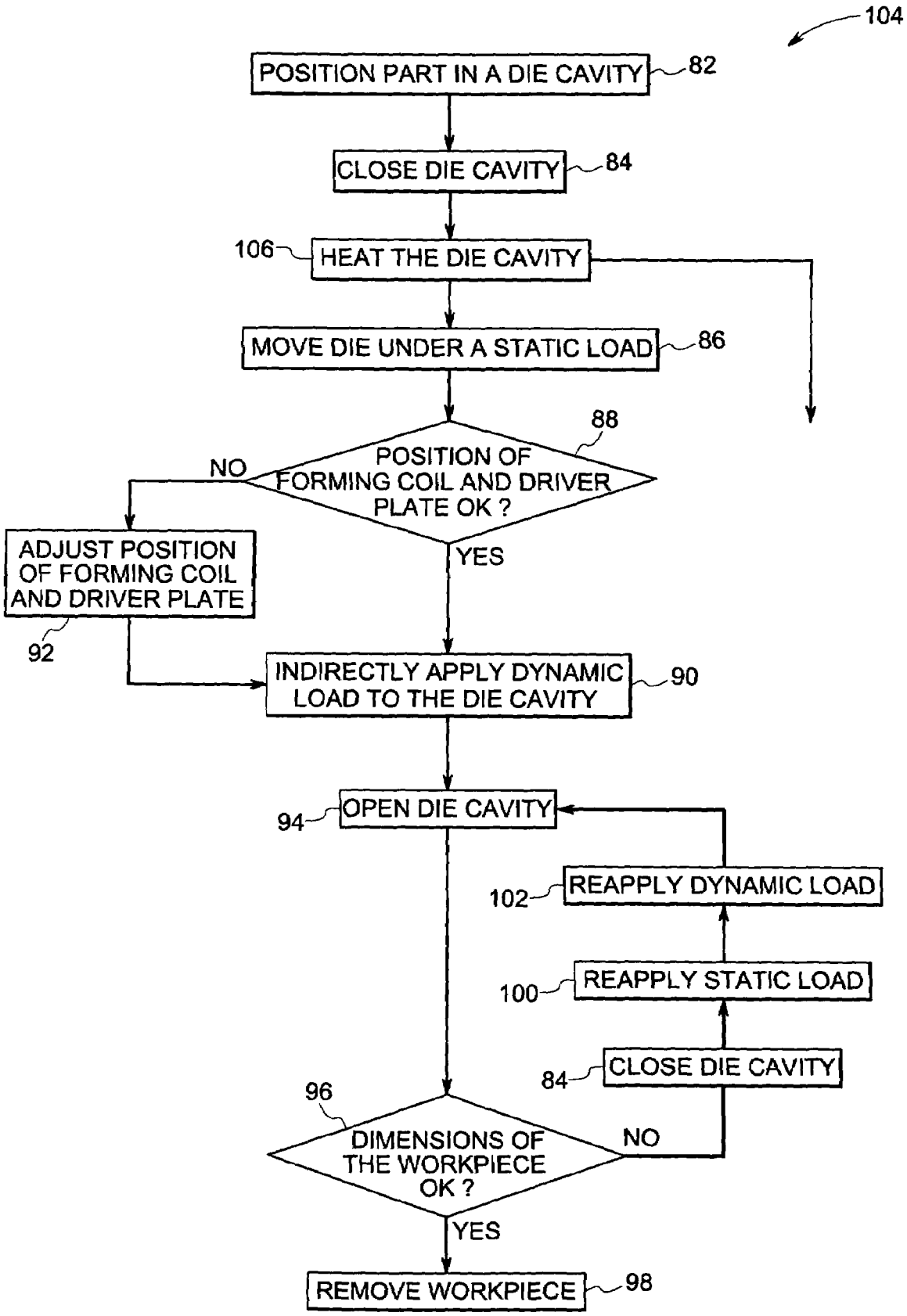
FIG. 9 is a flow chart illustrating a method of forming a part using the hybrid metal forming system of FIG. 1 according to another aspect of the invention.

Referring generally to FIGS. 1 and 8, an exemplary method 80 of forming a workpiece using hybrid forming system of FIG. 1 is illustrated in FIG. 8. The process 80 begins with positioning the workpiece 16 in the die cavity 22 at step 82. The workpiece 16 may be positioned between the first die 18 and the second die 20. Next, the die cavity 22 is closed at step 84 and a static load is applied to the die cavity 22 at step 86. The application of the static load to the die cavity 22 includes moving the first die 18 into a desired position by applying the static load at a low strain rate. In this embodiment, applying the load at a low strain rate comprises loading the first die 18 at a strain rate less than 1 $sec^{-1}$. As a result, the workpiece 16 is deformed in an elastic-plastic regime. It should be noted here, as used herein, the term "elastic-plastic regime" includes a regime where the stress-strain curve of the material of the workpiece 16 follows an elastic-plastic profile. As a result, an unloading curve of the material of the workpiece 16 follows an original loading curve for the material. It should be noted, however, that in many applications, the static load alone will generally be sufficient to bring about some deformation of the workpiece, although enhanced performance and forming, as well as resistance to spring back is realized by application of the dynamic load.

Next, the position of the forming coil 24 and the driver plate 26 is verified before application of the dynamic load via the dynamic load unit 14 (step 88). If the spacing between the forming coil 24 and the driver plate 26 is at the optimum distance then the process 80 proceeds to step 90. However, if the spacing between the forming coil 24 and the driver plate 26 is different than the optimum distance then the spacing is adjusted via the displacement sensing and control system 40 as shown in step 92 before the process 80 proceeds to step 90. At step 90, the process 80 proceeds with application of dynamic load to the die cavity 22. The application of dynamic load includes indirectly loading the first die 18 against the workpiece 16 at a high strain rate. In this embodiment, applying the load at a high strain rate comprises loading the first die 18 at a strain rate greater than 1 $sec^{-1}$. As a result, the workpiece 16 may be at least partially deformed in a hyperplastic regime.

It should be noted here, as used herein, the term "hyperplastic regime" includes a regime where the material of the workpiece 16 comprises an extended ductility in high velocity conditions. As will be appreciated by those skilled in the art the deformation of the workpiece 16 in the hyperplastic regime increases formability of the workpiece 16. Furthermore, the deformation under the high strain rate reduces spring back of the workpiece 16.

At step 94, the die cavity 22 is opened and the dimensions of the workpiece 16 are measured. Further, at decision step 96, the variations in the dimensions of the workpiece 16 are verified to be within desired tolerances. If the variations in dimensions of the workpiece 16 lie within the desired tolerances then the process 80 proceeds to step 98 where the formed workpiece 16 may be removed. If the variations in dimensions of the workpiece 16 lie outside the desired tolerances then the process 80 proceeds to step 84 where the die cavity 22 is opened and subsequently to step 100 where the static load is reapplied. Further, at step 102 the dynamic load may be reapplied for adjusting the dimensions of the workpiece 16.

The method of forming illustrated hereinabove may have certain additional steps to enhance the process of forming of the workpiece 16. For example, the process may have a mechanism for heating the die cavity 22 as shown in an exemplary process 104 illustrated in FIG. 9. In the illustrated method, the die cavity 22 may be heated via the heating unit 42 as shown in step 106. Alternatively, the workpiece 16 may be heated via the heating unit 42 to enhance the formability of the workpiece 16.

Figure 10:
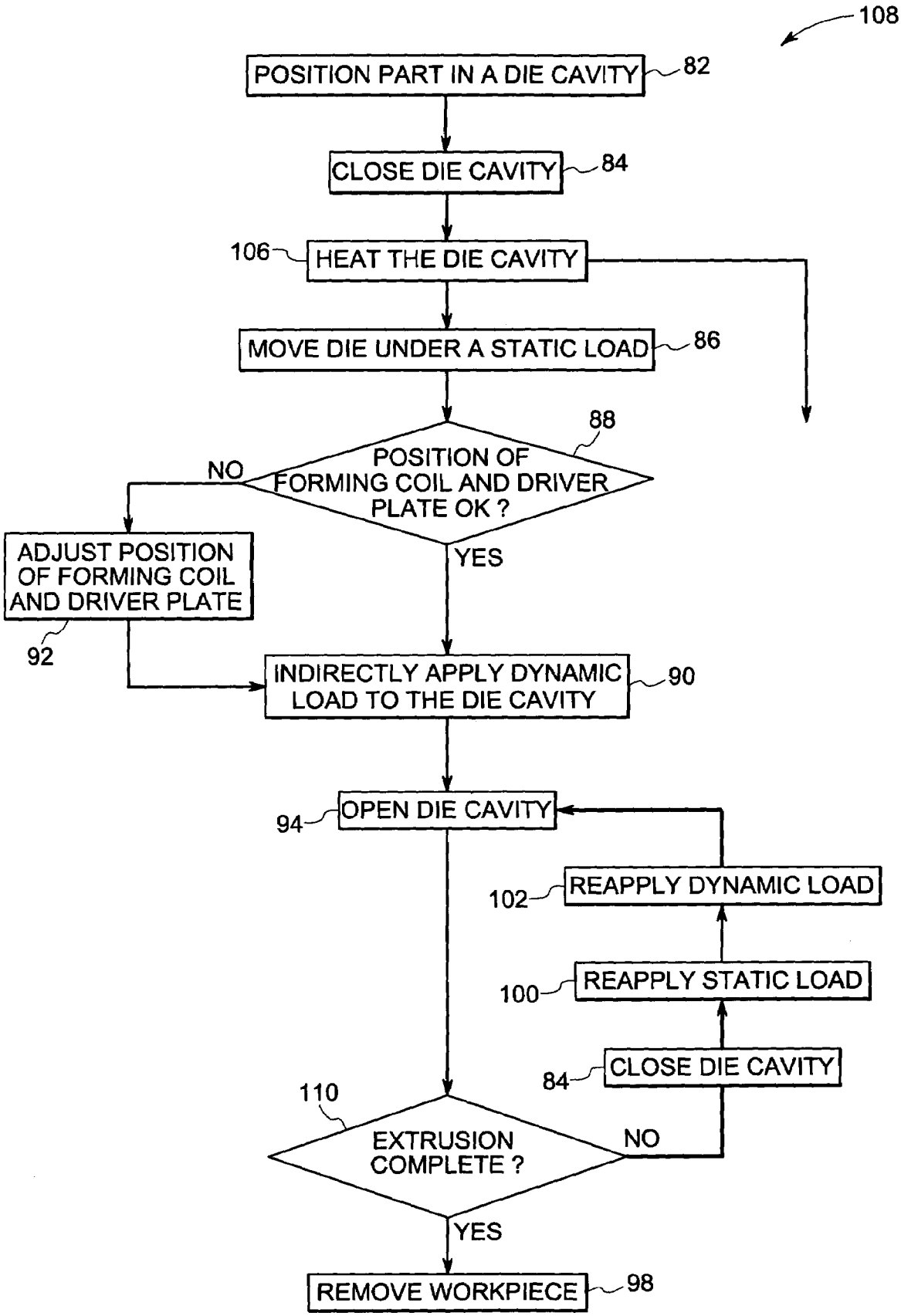
FIG. 10 is a flow chart illustrating a method of extrusion of a part using the hybrid metal forming system of FIG. 3 according to another aspect of the invention.

FIG. 10 illustrates an exemplary method 108 for the extrusion of the workpiece 16. The extrusion process 108 includes the application of static load and the dynamic load as illustrated in steps 82 to 90 that are described in detail above. Further, the die cavity 22 may be opened as shown in step 94 and at step 110, the process 108 verifies if the extrusion of the workpiece 16 is completed. If the extrusion of the workpiece is completed, the process 108 proceeds to steps 98 where the workpiece 16 is removed from the die cavity 22. Alternatively, if the extrusion is incomplete then the application of the static load and the dynamic load are iterated to achieve the desired extrusion of the workpiece 16 as shown in steps 100 and 102. Additionally, as can be seen the die cavity 22 may be heated as shown in step 106 to enhance the formability of the workpiece 16.

Figure 11:
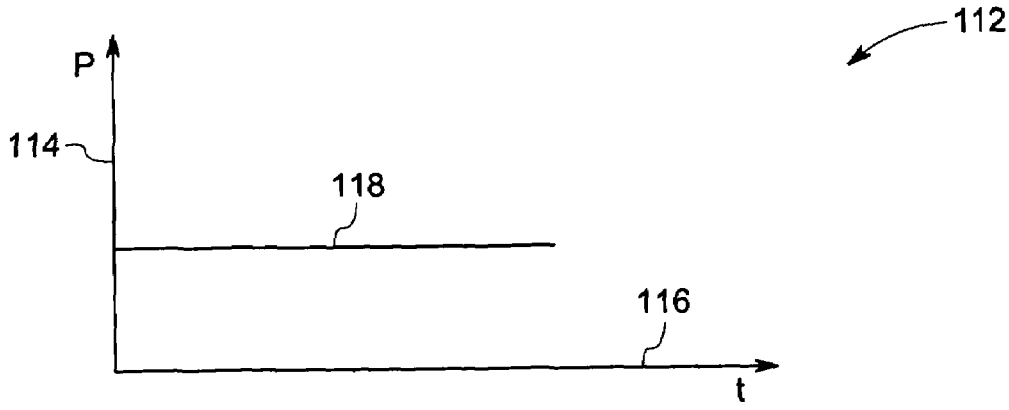
FIG. 11 is a graphical representation of a pressure distribution, in this case a constant pressure for a workpiece deformed under a static load.
Figure 12:
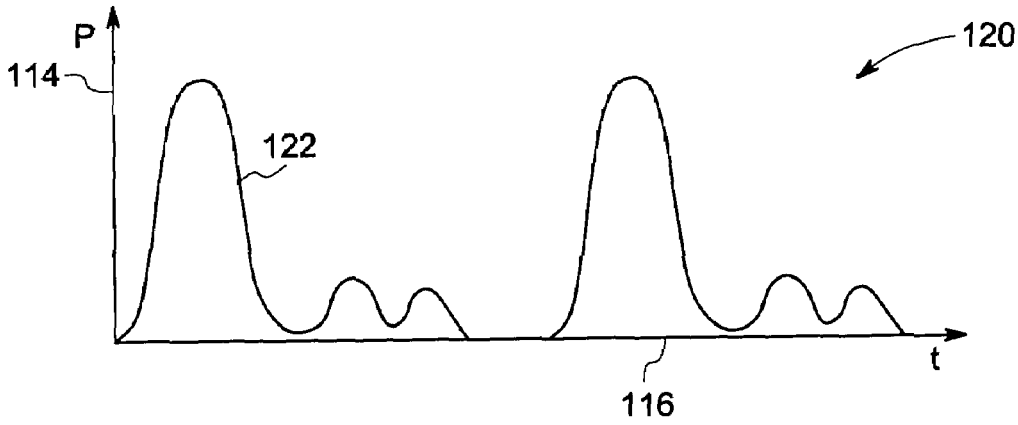
FIG. 12 is a graphical representation of a pressure distribution for a workpiece deformed under a dynamic load.

FIG. 11 is a graphical representation of an exemplary pressure distribution 112 of the workpiece 16 deformed under the static load. The ordinate axis 114 of the pressure distribution 112 represents the pressure and the abscissa axis 116 of the pressure distribution 112 represents time duration. As can be seen, here a pressure profile 118 is linear and the pressure is at a constant value over a period of time although the pressure may be a time varying load based upon the strain rate or deformation regime implied by the rate of change of the loading as described earlier. FIG. 12 is a graphical representation of an exemplary pressure distribution 120 of the workpiece 16 deformed under the dynamic load. As illustrated above, the ordinate axis 114 of the pressure distribution 120 represents the pressure and the abscissa axis 116 of the pressure distribution 112 represents time duration. As seen, a pressure profile 122 over a period has a non-linear behavior with certain peaks at certain period.

Figure 13:
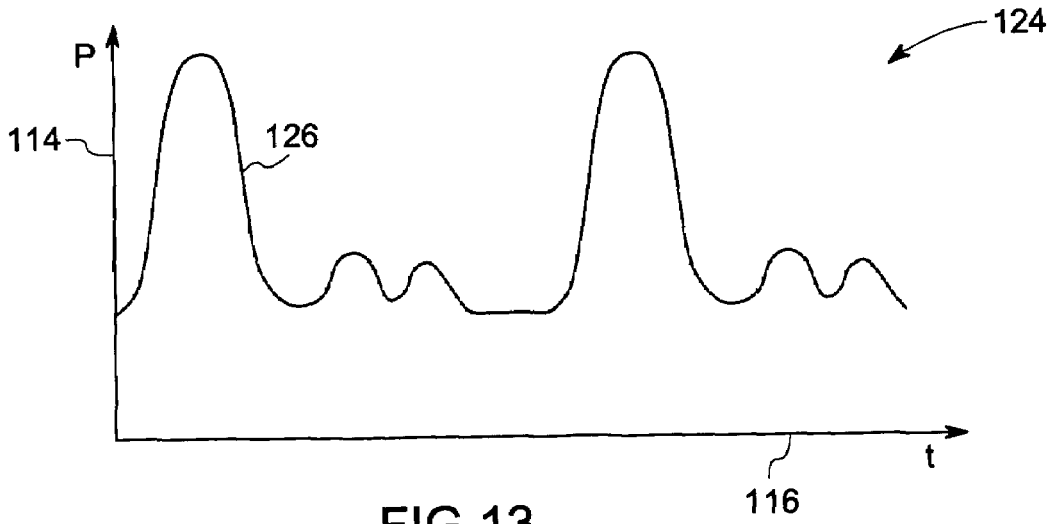
FIG. 13 is a graphical representation of a pressure distribution for a workpiece deformed under a combination of a static load and a dynamic load.

FIG. 13 is a graphical representation of an exemplary pressure distribution 124 of the workpiece 16 deformed under integration of the static load and the dynamic load. As can be seen from a pressure profile 126 the static load maintains the dynamic load at optimal conditions that enables the hybrid forming technique to be efficient for precision workpiece forming and repair.

The technique illustrated above employs an integration of static and dynamic loading for precision forming and repair of workpieces in a manufacturing environment. It should be noted that the static loading reduces the energy requirement for the dynamic loading thus making the forming and repair process more efficient. Further, the integration of the static and the dynamic loading enhances the formability of the workpiece. It should also be noted that, the indirect loading of the workpiece via the dynamic loading unit enables the dynamic loading unit to maintain an optimal configuration for workpieces with different conductivity. As a result, the indirect application of the dynamic load as discussed above may be advantageous for application of multiple shots of dynamic load for forming or repairing of the workpiece.

The various aspects of the forming and repair technique described above may be used in various manufacturing environments. For example, the technique may be used for manufacturing of engine blades for an aircraft engine that requires a high degree of precision. The method may also be used for repair applications for thin metal structures. As noted above, the method described here may be advantageous in precision forming and repair of workpieces while having adaptability for a wide range of workpieces.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A hybrid metal forming system comprising:

a die cavity defined by a first die and a second die;

a press adapted to apply a static pressure over the first die to deform a workpiece against the second die; and a dynamic loading system coupled to and positioned between, the press and the die cavity.

2. The system of claim 1, further comprising a stress enhancer unit disposed adjacent to the dynamic loading system to enhance a stress wave effect.

3. The system of claim 1, further comprising a heating unit coupled to the die cavity for heating at least one of the first die and the second die.

4. The system of claim 3, wherein the heating unit comprises an electrical heating element disposed adjacent the die cavity.

5. The system of claim 3, wherein the heating unit comprises of a heating furnace.

6. The system of claim 1, wherein the press comprises a mechanical press.

7. The system of claim 1, wherein the press comprises a hydraulic press.

8. The system of claim 1, wherein the dynamic loading system comprises an electromagnetic pressure unit.

9. The system of claim 8, wherein the electromagnetic pressure unit comprises of a forming coil and a driver plate.

10. The system of claim 9, wherein the driver plate comprises a conductive metal.

11. The system of claim 10, wherein the driver plate comprises copper.

12. The system of claim 10, wherein the driver plate comprises beryllium copper.

13. The system of claim 10, wherein the driver plate comprises aluminum alloy.

14. The system of claim 1, further comprising a displacement sensing and control system coupled to the forming coil and the driver plate to maintain a desired spacing between the forming coil and the driver plate.

15. The system of claim 1, wherein the dynamic loading system comprises an air driven impact pressing system.

16. The system of claim 1, wherein the dynamic loading system comprises, an impact pressing system driven by a spring.

17. The system of claim 1, wherein the dynamic loading system comprises of an impact pressing system driven by a hydraulic force.

18. A metal forming system, comprising:

means for moving a die to deform a workpiece under a static load; and means for indirectly dynamically loading the die while maintaining the static load.

19. The system of claim 18, wherein the die is coupled to an electromagnetic pressure unit via a forming coil of the electromagnetic pressure unit.

20. The system of claim 19, wherein the electromagnetic pressure unit further comprises a driver plate and means for controlling a distance between the forming coil and the driver plate.

21. A metal forming system, comprising:

means for moving a die to deform a workiiece in a elastic-plastic regime; and means for indirectly loading the die against the workpiece to deform the workpiece in a hyperplastic regime.

22. The system of claim 21, wherein the die is coupled to an electromagnetic pressure unit via a forming coil of the electromagnetic pressure unit.

23. The system of claim 22, wherein the electromagnetic pressure unit further comprises a driver plate and means for controlling a distance between the forming coil and the driver plate.

24. The system of claim 21, wherein the system is configured to increase the ductility of a material of the workpiece via indirectly loading the die against the workpiece to deform the workpiece in the hyperplastic regime.

25. A metal forming system, comprising:

means for moving a die into a desired position by applying a load at a low strain rate; and means for indirectly loading the die against the workpiece at a high strain rate.

26. The system of claim 25, wherein the low strain rate comprises a rate less than 1 $sec^{-1}$.

27. The system of claim 25, wherein the high strain rate comprises a rate higher than 1 $sec^{-1}$.

28. The system of claim 25, wherein the system is configured to reduce spring back of the workpiece via indirectly loading the die against the workpiece at the high strain rate.

* * * * *